US007122588B2

(12) United States Patent
Fujisawa et al.

(10) Patent No.: US 7,122,588 B2
(45) **Date of Patent: *Oct. 17, 2006**

(54) GOLF BALL

(75) Inventors: Koichi Fujisawa, Kobe (JP); Kazuhiko Isogawa, Kobe (JP)

(73) Assignee: Sri Sports Limited, Kobe (JP)

( * ) Notice: Subject to any disclaimer, the term of this patent is extended or adjusted under 35 U.S.C. 154(b) by 50 days.

This patent is subject to a terminal disclaimer.

(21) Appl. No.: 10/791,815

(22) Filed: Mar. 4, 2004

(65) Prior Publication Data

US 2004/0175574 A1 Sep. 9, 2004

(30) Foreign Application Priority Data

Mar. 7, 2003 (JP) ..... 2003-061942

(51) Int. Cl.
*A63B 37/14* (2006.01)
*A63B 37/00* (2006.01)

(52) U.S. Cl. ..... 524/126; 524/120; 524/128; 524/150; 524/151; 473/351; 473/356; 473/365; 473/378

(58) Field of Classification Search ..... 524/120, 524/126, 128, 150, 151; 473/351, 356, 365, 473/378

See application file for complete search history.

(56) References Cited

U.S. PATENT DOCUMENTS

| | | | | |
|---|---|---|---|---|
| 4,371,647 | A * | 2/1983 | Minagawa et al. | 524/120 |
| 5,298,559 | A * | 3/1994 | Fujii et al. | 525/67 |
| 5,300,257 | A * | 4/1994 | Akashi et al. | 252/400.24 |
| 5,409,233 | A * | 4/1995 | Kennedy | 473/377 |
| 6,509,410 | B1 * | 1/2003 | Ohira et al. | 524/591 |
| 2002/0086743 | A1 * | 7/2002 | Bulpett et al. | 473/371 |
| 2002/0098919 | A1 * | 7/2002 | Fushihara et al. | 473/378 |
| 2004/0235588 | A1 * | 11/2004 | Fujisawa et al. | 473/378 |

FOREIGN PATENT DOCUMENTS

| | | | |
|---|---|---|---|
| JP | 7-51403 | A | 2/1995 |
| JP | 2000-342718 | A | 12/2000 |
| JP | 2001-17576 | A | 1/2001 |

OTHER PUBLICATIONS

ADK Stab Phosphites product literature obtained from Asahi Denka.*

* cited by examiner

*Primary Examiner*—David J. Buttner
(74) *Attorney, Agent, or Firm*—Birch, Stewart, Kolasch and Birch, LLP

(57) ABSTRACT

The object of the present invention is to provide a golf ball having a paint film which is excellent in the adhesion, the durability and the coloring-resistance. The golf ball of the present invention comprises a paint film formed on the surface of a golf ball body, wherein the paint film contains 0.05 to 5 parts by mass of a phosphorus stabilizer with respect to 100 parts by mass of a resin component.

8 Claims, No Drawings

GOLF BALL

This Non-provisional application claims priority under 35 U.S.C. § 119(a) on Patent Application No(s). 2003-061942 filed in Japan on Mar. 7, 2003, the entire contents of which are hereby incorporated by reference.

BACKGROUND OF THE INVENTION

1. Field of the Invention

The present invention relates to a golf ball, more particularly to a golf ball having a paint film formed on the surface of the golf ball body.

2. Description of the Related Art

Conventionally, a golf ball has a paint film on the surface of the golf ball body in order to establish the gloss or to protect the mark and the golf ball body. The requirements for the paint film covering the golf ball body are the adhesion and the durability against the impact of the shot and the weather-resistance to prevent the coloring or the deterioration caused by sunlight and rain.

Japanese unexamined patent publication No. H12-342718 discloses a process for making a golf ball where the adhesion reinforcing layer comprising the silyl compound is formed between the paint film and the surface of the golf ball body in order to improve the adhesion of the paint film. Japanese unexamined patent publication No. H07-51403 discloses a golf ball having a weather-resistant paint film where the clear paint film includes a hindered phenol type antioxidant. Japanese unexamined patent publication No. 2001-17576 discloses a golf ball having a clear paint film which includes a fluorescent brightener and an ultraviolet absorber.

SUMMARY OF THE INVENTION

The golf ball is used in a severe condition, for example, being subjected to a large deformation when hit, and the friction against the ground or the like. Thus, the higher degree of the adhesion is required between the paint film and the golf ball body. If the paint film peels off from the golf ball, the appearance of the golf ball will be deteriorated. In addition, the golf ball body is supposed to be exposed to the sun light including a ultraviolet ray, thus the performance of the golf ball will be lowered with time. Especially, since the golf ball used in the golf range is subjected to the repeated brushing-wash in addition to the repeated shots, it is required for the paint film of the golf ball to have the durability as well as the adhesion to the golf ball body. In view of these aspects, it is very important to improve the durability and the adhesion of the paint film.

The paint film disclosed in Japanese unexamined patent publication No. H07-51403 occasionally changes in color with time. This is attributed to the fact that the hindered phenol type antioxidant used changes into the compound which develops yellow or red color.

The present invention has been achieved in view of the above problems. The object of the present invention is to provide the golf ball having a paint film which is excellent in the adhesion, the durability, and the coloring-resistance.

The present invention provides a golf ball comprising a paint film formed on the surface of the golf ball body, wherein the paint film contains 0.05 to 5 parts by mass of a phosphorus stabilizer with respect to 100 parts by mass of the resin component.

DESCRIPTION OF THE PREFERRED EMBODIMENT

The golf ball of the present invention comprises a paint film formed on the surface of the golf ball body, wherein the paint film contains the phosphorus stabilizer and the resin component, and the phosphorus stabilizer is contained in an amount of 0.05 to 5 parts by mass with respect to 100 parts by mass of the resin component.

First of all, the phosphorus stabilizer will be explained. The phosphorus stabilizer used in the present invention includes a stabilizer derived from an oxo-acid of phosphorus and provides the paint film with the durability and the adhesion as well as inhibits the color-change of the paint film with time. In view of this aspect, the paint film contains the phosphorus stabilizer in an amount of not less than 0.05 part by mass, more preferably not less than 0.1 part by mass, while the paint film contains the phosphorus stabilizer in an amount of not more than 5 parts by mass, more preferably of 4 parts by mass. If the amount of the phosphorus stabilizer is less than 0.05 part by mass, the improvement of the adhesion and the durability imparted by the phosphorus stabilizer is not sufficient, while if the amount is more than 5 parts by mass, the adhesion and the durability will be lowered, although the coloring resistance is improved.

In the present invention, it is not clear how the phosphorus stabilizer contained in the paint film works to improve the adhesion and the durability. However, the following phosphorus stabilizers are preferably used in the present invention. Examples of the phosphorus stabilizer are a hypophosphorous acid compound (phosphinic acid compound), a phosphorous acid compound (phosphonic acid) or a derivative thereof.

The hypophosphorous acid compound includes, for example, a hypophosphite (ester of hypophosphorous acid compound) and a derivative thereof. Examples of the hypophosphite and a derivative thereof are tetrakis (2,4-di-tert-butylphenyl)[1,1'-biphenyl]-4,4'-diylbisphosphonite, tetrakis (2,4-di-tert-butyl-5-methylphenyl)[1,1'-biphenyl]-4,4'-diylbisphosphonite.

The phosphorous acid compound includes a phosphite having at least one functional group selected from the group consisting of alkyl group, phenyl group, and alkylphenyl group; and a derivative thereof (phosphonate and a derivative thereof), for example, tris (alkylphenyl)phosphite, tris (alkyl)phosphite, and pentaerythritol phosphite derivative.

Examples of the phosphite and the derivative thereof are the tris(alkylphenyl)phosphite such as tris(nonylphenyl) phosphite, tris(2,4-di-tert-butylphenyl)phosphite; the pentaerythritol phosphite derivative such as di(tridecyl)pentaerythritol diphosphite, di(nonylphenyl)pentaerythritol diphosphite, di(isodecyl)pentaerythritol diphosphite, di(stearyl)pentaerythritol diphosphite, di(2,4-di-tert-butylphenyl)pentaerythritol diphosphite, di(2,6-di-tert-butyl-4-methylphenyl)pentaerythritol diphosphite, hydrogenated bisphenol A pentaerythritol phosphite polymer, tetraphenyltetra(tridecyl)pentaerythritol tetraphosphite; other phosphates such as phenyldi(isodecyl)phosphite, cyclic neopentane tetrayl(octadecylphosphite), 2,2'-methylenebis(4,6-di-tert-butylphenyl)octylphos phite; hydrogenated bisphenol A phosphite polymer, tetra(tridecyl)-4,4'-isopropylydenediphenyl diphosphite, tetraphenyldipropyleneglycol diphosphite.

Among the above phosphorus stabilizers, the following compounds are preferable.

tetrakis(2,4-di-tert-butylphenyl)[1,1-biphenyl]-4,4'-diylbisphosphonite represented by formula 1;

tetrakis(2,4-di-tert-butyl-5-methylphenyl)[1,1-biphenyl]-4,4'-diylbisphosphonite represented by formula 2;

tris(2,4-di-tert-butylphenyl)phosphite represented by formula 3;

di(stearyl)pentaerythritol diphosphite represented by formula 4;

di(2,4-di-tert-butylphenyl)pentaerythritol diphosphite represented by formula 5;

di(2,6-di-tert-butyl-4-methylphenyl)pentaerythritol diphosphite represented by formula 6; and 2,2'-methylenebis(4,6-di-tert-butylphenyl)octylphos phite represented by formula 7. These phosphorus stabilizers impart the excellent adhesion and durability as well as coloring-resistance to the paint film.

(1)

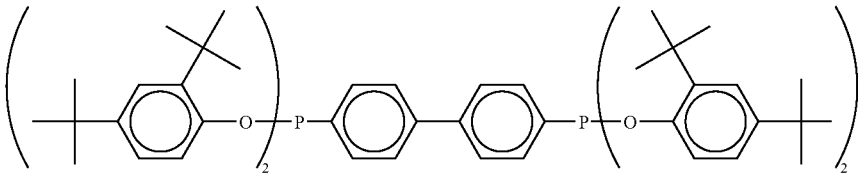

Formula 1

(2)

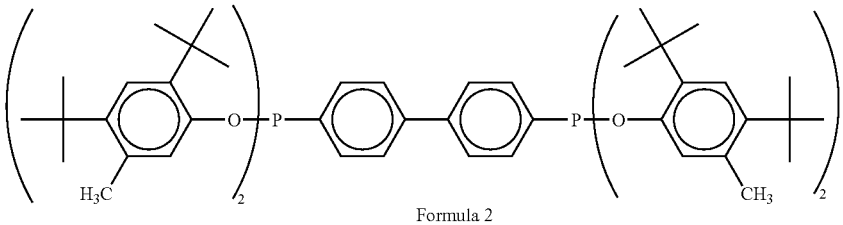

Formula 2

(3)

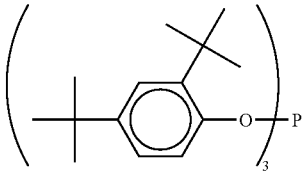

Formula 3

(4)

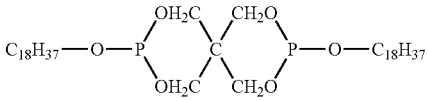

Formula 4

(5)

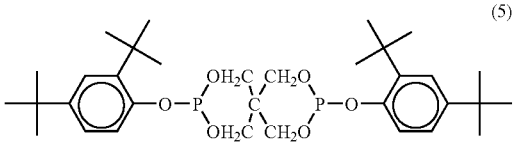

Formula 5

(6)

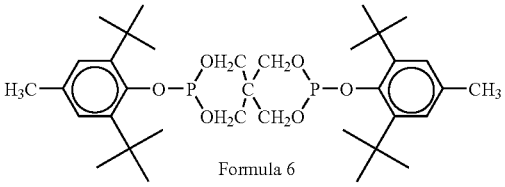

Formula 6

(7)

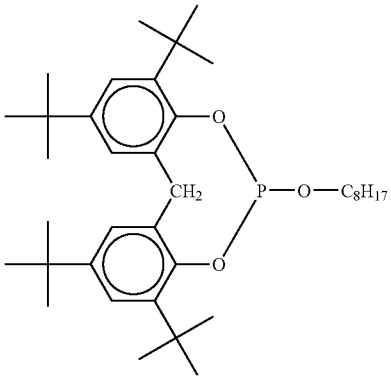

Formula 7

In the golf ball of the present invention, the resin component contained in the paint film is not restricted, and includes a conventional component used for the golf ball paint film, for example, the acrylic resin, the epoxy resin, the urethane resin, the polyester type resin, and the cellulose type resin. Among them, the two-component curing type urethane resin as described later is preferable. In general, the use of the two-component curing type urethane resin provides the paint film with an excellent durability and abrasion resistance.

The two-component curing type urethane resin is a urethane resin obtainable by the curing reaction between the base material and the curing agent. For example, the urethane resin is obtained by curing the base material containing an isocyanate-group terminated urethane prepolymer with the curing agent having an active hydrogen, or curing the base material containing the polyol component with the polyisocyanate or a derivative thereof.

In the present invention, typically preferred as the resin component of the paint film is the two-component curing type urethane resin which is obtainable by curing the base material containing the polyol component with the curing agent such as the polyisocyanate or a derivative thereof.

As the base material containing the polyol component, the following specific urethane polyol is preferable. The urethane polyol includes any polyol having a urethane bond and at least two hydroxyl groups (preferably at the terminal thereof). The urethane polyol is, for example, obtained by reacting a polyol with a polyisocyanate in such a molar ratio that the hydroxyl group of the polyol component is excess to the isocyanate group of the polyisocyanate.

The polyisocyanate for producing the urethane polyol is not limited, as long as it has at least two isocyanate groups. Examples of the polyisocyanate are an aromatic polyisocyanate such as 2,4-tolylene diisocyanate, 2,6-tolylene diisocyanate, a mixture (TDI) of 2,4-tolylene diisocyanate and 2,6-tolylene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate(TMXDI) and paraphenylene diisocyanate (PPDI); and an alicyclic or aliphatic polyisocyanate such as 4,4'-dicyclohexylmethane diisocyanate (hydrogenated MDI), hydrogenated xylylenediisocyanate($H_6$XDI) hexamethylene diisocyanate (HDI), and isophorone diisocyanate (IPDI). The polyisocyanate can be used either alone or in combination of two or more. Among them, non-yellowing type polyisocyanate (TMXDI, XDI, $H_6$XDI, IPDI, $H_{12}$MDI) are preferable in view of weather resistance. In addition, the above polyisocyanate can be used as a curing agent for curing the urethane polyol.

The polyol for producing the urethane polyol is not limited, as long as it has a plurality of hydroxyl groups. The polyol includes, for example, a low-molecular weight of polyol and a high-molecular weight of polyol. Examples of the low-molecular weight of polyol are a diol such as ethylene glycol, diethylene glycol, triethylene glycol, 1,3-butanediol, 1,4-butanediol, neopentyl glycol, 1,6-hexane glycol; or a triol such as glycerin, trimethylol propane, and hexanetriol. Examples of the high-molecular weight of polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); a polycarbonate polyol such as polyhexamethylene carbonate; and an acrylic polyol. Among them, preferably used is the polyol having a weight average molecular weight of not less than 50, more preferably not less than about 100, and having a weight average molecular weight of not more than 2000, more preferably not more than about 1000. The above polyol can be used individually or in combination of at least two of them.

Preferably, the urethane polyol has urethane bonds in a ratio of 0.1 to 5 mmol/g with respect to 1 gram of the urethane polyol. The ratio of urethane bond affects the stiffness of the resulting paint film. If the ratio of urethane bonds is less than 0.1 mmol/g, the concentration of the urethane bond in the paint film becomes too low to provide a sufficient scuff resistance. If the ratio of urethane bonds is greater than 5 mmol/g, the paint film has excessively high hardness. Such a hard paint film does not follow the deformation of the golf ball body, resulting in crack of the paint film.

The urethane polyol preferably has a weight average molecular weight of 4000 or more, more preferably a weight average molecular weight of 4500 or more, and preferably has a weight average molecular weight below 10000, more preferably a weight average molecular weight of 9000 or less. When the molecular weight of the urethane polyol is less than 4000, drying process requires a longer time. As a result, coating workability and productivity of golf balls tend to become low. While if the molecular weight of the urethane polyol is 10000 or greater, the hydroxyl value of the urethane polyol becomes relatively small. Thus, the reaction ratio between the paint film and the surface of the golf ball becomes low. Consequently, the adhesion of the paint film to the surface of the golf ball tends to be low. Further, the use of urethane polyol having a weight average molecular weight of 9000 or less allows the paint film to form a dense layer which does not lower the adhesion even in a wet condition.

The urethane polyol preferably has a hydroxyl value of not less than 15 mgKOH/g, more preferably not less than 73 mgKOH/g, and preferably has a hydroxyl value of not more than 130 mgKOH/g, more preferably not more than 120 mgKOH/g. If the hydroxyl value is less than 15 mgKOH/g, the reaction between the urethane polyol and the curing agent tends to be insufficient. The insufficient reaction causes the lower adhesion of the paint film to the golf ball body. On the other hand, if the hydroxyl value is more than 130 mgKOH/g, the reaction with the curing agent tends to require longer time, resulting in longer drying time and lower productivity.

The above urethane polyol is obtainable by reacting the polyisocyanate and the polyol. In the reaction for producing the urethane polyol, a solvent or a catalyst (for example, dibutyl tin dilaurate), which are well-known for producing polyurethane, may be used. The ratio of the urethane bond can be controlled by adjusting the blending ratio between the polyisocyanate and the polyol, or by selecting the molecular weight of the polyol as a raw material.

In one preferable embodiment, the polyol constituting the base material is the above urethane polyol itself, namely, the base material is substantially the above urethane polyol. In another preferable embodiment, the polyol, which is compatible with the above urethane polyol and has no urethane bond, may be contained in the base material, in addition to the urethane polyol. In this case, the polyol having no urethane bond includes, without limitation, the above polyol which is described as a raw material for producing the urethane polyol. In the case that the polyol having no urethane bond is contained in the base material, the amount of the urethane polyol contained in the base material is preferably not less than 50 mass %, more preferably not less than 80 mass %. If the amount of the urethane polyol contained in the base material is less than 50 mass %, the content of the urethane polyol becomes relatively small. Thus, the drying time tends to be longer.

The paint film of the invented golf ball may further contain a conventional additive such as an UV absorber, an antioxidant, a light stabilizer, a fluorescent brightener, an anti-blocking agent, and a pigment, in addition to the above resin component and the phosphorus stabilizer. In a preferable embodiment, the paint film is a clear paint film which does not contain a pigment substantially.

The paint film can be formed on the surface of the golf ball body by coating and drying the paint composition containing the above resin component and the phosphorus stabilizer, if necessary a solvent and the above additives, on the surface of the golf ball body. The paint film may have a single layered structure or a multi-layered structure. Preferably, the paint film has a single layered structure. Since the paint film in the present invention is excellent in the adhesion to the golf ball and the durability, the paint film performs sufficiently enough, even if the paint film has a single layered structure. The paint film has, without limitation, the preferable thickness of 5 to 20 μm. If the thickness is less than 5 μm, the paint film performs insufficiently, while if the thickness is more than 20 μm, the flying performance may be lowered due to the change in the depth of the dimples.

The golf ball of the present invention has no limitation on its structure and includes a one-piece golf ball, a two-piece golf ball, a multi-piece golf ball comprising at least three layers, and a wound-core golf ball. The present invention can be applied for all types of the golf ball.

Especially in the cases of the two-piece golf ball, the multi-piece golf ball, and a wound-core golf ball, an ionomer resin, a polyester resin, a urethane resin such as a thermoplastic urethane resin or a two-component curing type urethane resin, a polyamide resin can be used individually or in the combination of at least two of them as the cover material. In a preferable embodiment, the cover material contains the urethane resin such as the thermoplastic urethane resin or the two-component curing type urethane resin, the ionomer resin, or the mixture of the ionomer resin and the urethane resin in an amount of preferably not less than 50 mass %, more preferably not less than 75 mass %, even more preferably not less than 90 mass %. The higher content of the urethane resin and the ionomer resin will improve the durability and the shot feeling of the resulting cover. Further, the paint film containing the phosphorus stabilizer shows the good adhesion to these covers and improves the durability thereof.

The ionomer resin constituting the cover includes a conventional ionomer resin which is used as a cover material for the golf ball. Examples of the ionomer resin are one prepared by neutralizing at least a part of carboxyl groups in a copolymer composed of ethylene and α,β-unsaturated carboxylic acid with a metal ion, and one prepared by neutralizing at least a part of carboxyl groups in a terpolymer composed of ethylene, α,β-unsaturated carboxylic acid and α,β-unsaturated carboxylic acid ester with a metal ion.

The metal ion for neutralizing the carboxyl group includes a monovalent ion such as sodium ion, potassium ion, and lithium ion; or a divalent ion such as zinc ion, calcium ion, magnesium ion; or a trivalent metal ion such as aluminum and neodymium. Among them, zinc ion is preferable because the bonding strength of the resulting aggregate composed of the metal ions is large enough to minimize the lowering of the mechanical properties caused by the dispersed particles of the crosslinked diene rubber.

Examples of the ionomer resin are, but not limited to, HIMILAN 1605 (commercial name of sodium ion neutralized ethylene-methacrylic acid copolymer), HIMILAN 1707 (commercial name of sodium ion neutralized ethylene-methacrylic acid copolymer), HIMILAN 1706 (commercial name of zinc ion neutralized ethylene-methacrylic acid copolymer), HIMILAN AM7315 (commercial name of zinc ion neutralized ethylene-methacrylic acid copolymer), HIMILAN AM7317 (commercial name of zinc ion neutralized ethylene-methacrylic acid copolymer), HIMILAN 1555 (commercial name of sodium ion neutralized ethylene-methacrylic acid copolymer), produced by MITSUI-DUPONT POLYCHEMICAL CO.; IOTEK 8000 (commercial name of sodium ion neutralized ethylene-methacrylic acid copolymer), IOTEK 7010 (commercial name of zinc ion neutralized ethylene-methacrylic acid copolymer), produced by Exxon Co.; SURLYN 7930 (commercial name of lithium ion neutralized ethylene-methacrylic acid copolymer), SURLYN 9945 (commercial name of zinc ion neutralized ethylene-methacrylic acid copolymer), SURLYN 8945 (commercial name of sodium ion neutralized ethylene-methacrylic acid copolymer), produced by DUPONT CO. These ionomers may be used individually or as a mixture of two or more of them.

The urethane resin constituting the cover may include a thermoplastic urethane resin, or a two-component curing type urethane resin which is obtainable by curing the isocyanate group terminated urethane prepolymer with an aromatic polyamine. The polyisocyanate component and the polyol component for the urethane resin may include, but are not limited to, the same polyisocyanate and polyol for the urethane resin contained the paint film described above. It is preferable to use the urethane resin which employs TDI as the polyisocyanate component and PTMG as the polyol component. The aromatic polyamine may include any polyamine compound which has at least two amino groups bonded to the aromatic ring directly or indirectly.

Examples of the aromatic polyamine are one where amino groups are directly bonded to the aromatic ring such as phenylene diamine, toluene diamine, diethyltoluene diamine; one where amino groups are bonded to the aromatic ring through the sulfide bond such as dimethyltiotoluenediamine; one where amino groups are bonded to the aromatic ring through the lower alkylene groups such as xylene diamine; and 4,4'-diaminodiphenylmethane and a derivative thereof.

In the present invention, the paint film containing the phosphorus stabilizer exhibits the excellent durability and the excellent adhesion even to the one-piece golf ball obtained by vulcanizing-molding a rubber composition. The rubber composition preferably comprises a diene rubber as a base rubber, a co-crosslinking agent, and a crosslinking initiator. The diene rubber preferably includes a high cis-polybutadiene rubber having cis-1,4 bond in a proportion of not less than 40%, more preferably not less than 70%, even more preferably not less than 90%, in view of the high repulsion.

The co-crosslinking agent used in the present invention includes, for example, an α,β-unsaturated carboxylic acid or a metal salt thereof. Typically preferred is the α,β-unsaturated carboxylic acid having 3 to 8 carbon atoms such as acrylic acid and methacrylic acid or the metal salt thereof. As the metal forming the metal salt of the α,β-unsaturated carboxylic acid, zinc, magnesium, calcium, aluminum or sodium is preferably used. Among them, zinc is more preferable, because it can impart the higher repulsion property to the golf ball.

The amount of the co-crosslinking agent to be blended in the rubber composition is preferably from 20 parts by mass, more preferably from 25 part by mass, and is preferably to 50 parts by mass, more preferably to 40 parts by mass based on 100 parts by mass of the base rubber. As the crosslinking initiator, an organic peroxide is preferably used. Examples of the organic peroxide are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. The amount of the organic peroxide to be blended in the rubber composition is preferably from 0.2 part by mass, more preferably from 0.3 part by mass, and is preferably to 1.0 part by mass, more preferably to 1.5 parts by mass based on 100 parts by mass of the base rubber. The condition for press-molding the rubber composition can be appropriately determined based on the rubber composition. Conventionally, the rubber composition can be press-molded at the heating condition of 160° C. for 30 minutes.

The rubber composition and the cover material described above may further contain a specific gravity adjusting agent such as zinc oxide and barium sulfate, an antioxidant, a color powder or a pigment such as titanium oxide, and the like, as required.

In the following, the method for preparing the golf ball of the present invention will be explained based on the embodiment of the two-piece golf ball, but the present invention is not limited to the two-piece golf ball and the process explained below. The present invention can employ any core which is well-known as the core for the two-piece golf ball. The core of the two-piece golf ball, for example, without limitation, is preferably a molded body which is formed by vulcanizing a rubber composition. The rubber composition preferably comprises a base rubber, a co-crosslinking agent, and a crosslinking initiator.

As the rubber composition for the core, the same rubber composition for the one-piece golf ball described above can be used. The rubber composition may further include a specific gravity adjusting agent, an antioxidant, a color powder, and the like, as required. The condition for press molding the rubber composition can be appropriately determined on the rubber composition. The press-molding of the rubber composition for the core is conventionally conducted at the temperature of 130 to 200° C. for 10 to 60 minutes. Alternatively, the press-molding is preferably carried out in a two-step heating, for example, at the temperature of 130 to 150° C. for 20 to 40 minutes, and continuously at the temperature of 160 to 180° C. for 5 to 15 minutes.

The core thus obtained is covered with the cover material to form a golf ball body. Further, when forming the cover, the cover can be formed with a multiplicity of concavities, which is so called "dimple", at the surface thereof. As required, the surface of the golf ball body can be subjected to grinding treatment such as sandblast in order to enhance the adhesion of the paint film.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

(1) Evaluation Method (1-1) Coloring-resistance

The golf balls were subjected to the outdoor exposure test for 6 months. The change in the color of the paint film was visually observed.

Criteria:
Good: Change in color was not observed.
Poor: Change in color was observed.

(1-2) Durability and the Adhesion Against the Impact of the Shot

Each golf ball was hit 150 times repeatedly with an iron (#5) attached to a swing robot manufactured by TRUETEMPER CO, at the head speed of 34 m/sec. The peeling condition of the paint film and the mark was visually observed, and the durability and the adhesion were evaluated based on the following criteria.

Criteria for the Paint Film:
Excellent: No peeling area of the paint film
Good: The peeling area of the paint film is not more than 5% with respect to the total area of the paint film.
Fair: The peeling area of the paint film is 5% (exclusive) to 20% with respect to the total area of the paint film.
Poor: The peeling area of the paint film is more than 20% with respect to the total area of the paint film.

Criteria for the Mark:
Excellent: No peeling area of the mark
Good: The peeling area of the mark is not more than 5% with respect to the total area of the mark.
Fair: The peeling area of the mark is 5% (exclusive) to 20% with respect to the total area of the mark.
Poor: The peeling area of the mark is more than 20% with respect to the total area of the mark.

(1-3) Adhesion and Durability Against Brushing Wash

Each golf ball was subjected to brushing wash for 1 hour in the potato peeler having the inside surface covered with the brush. The peeling condition of the paint film and the mark was visually observed, and evaluated according to the following criteria.

Criteria for the Paint Film:
Excellent: No peeling area of the paint film
Good: The peeling area of the paint film is not more than 5% with respect to the total area of the paint film.
Fair: The peeling area of the paint film is 5% (exclusive) to 20% with respect to the total area of the paint film.
Poor: The peeling area of the paint film is more than 20% with respect to the total area of the paint film.

Criteria for the Mark:
Excellent: No peeling area of the mark
Good: The peeling area of the mark is not more than 5% with respect to the total area of the mark.
Fair: The peeling area of the mark is 5% (exclusive) to 20% with respect to the total area of the mark.
Poor: The peeling area of the mark is more than 20% with respect to the total area of the mark.

(2) Production of the One-piece Golf Ball Body

The rubber composition shown in Table 1 was kneaded and press-molded at 160° C. for 30 minutes to obtain the one-piece golf ball body.

TABLE 1

| Rubber composition | Parts by mass |
|---|---|
| Polybutadiene Rubber | 100 |
| Zinc oxide | 23.5 |
| methacrylic acid | 24.0 |
| Dicumyl peroxide | 0.6 |
| Titanium oxide | 1 |
| Blue Pigment | 0.05 |

Note on Table 1:

Polybutadiene rubber: BR-11 (cis content:96%) available from JSR Co.

Zinc oxide: "Ginrei R" produced by Toho-Zinc Co.

Dicumyl peroxide: "Percumyl D" produced by NOF corporation.

(3) Production of the Two-piece Golf Ball Body (3-1) Preparation of Solid Core.

The rubber composition shown in Table 2 was kneaded and pressed in upper and lower molds each having a spherical cavity at the heating condition of 160° C. for 13 minutes to obtain the solid core in a spherical shape having a diameter of 39.3 mm.

TABLE 2

| Core Rubber composition | Parts by mass |
|---|---|
| Polybutadiene Rubber | 100 |
| Zinc oxide | 5.6 |
| Zinc acrylate | 22.0 |
| Calcium carbonate | 21.0 |
| Dicumyl peroxide | 1.85 |

Note on Table 2:

Polybutadiene rubber: BR-11 (cis content:96%) available from JSR Co.

Zinc acrylate: "ZNDA-90S" produced by NIHON JYORYU KOGYO Co,. LTD.

Zinc oxide: "Ginrei R" produced by Toho-Zinc Co.

Dicumyl peroxide: "Percumyl D" produced by NOF corporation.

(3-2) Preparation of the Cover Material

The materials shown in Table 3 and Table 4 were mixed using a twin-screw kneading extruder to obtain the cover composition in the form of pellet. The extrusion was conducted in the following conditions:

screw diameter=45 mm, screw revolutions=250 rpm, screw L/D=35, and the cover composition was heated to from 200° C. to 260° C. at the die position of the extruder.

TABLE 3

| Ionomer cover formulation | Parts by mass |
|---|---|
| Himilan 1605 | 40 |
| Himilan 1706 | 30 |
| Himilan 1707 | 30 |
| Titanium oxide | 2 |

Notes on Table 3:

HIMILAN 1605: an ionomer resin of a sodium ion-neutralized ethylene-methacrylic acid copolymer, available from MITSUI-DUPONT POLYCHEMICAL CO., LTD.

HIMILAN 1706: an ionomer resin of a zinc ion-neutralized ethylene-methacrylic acid copolymer, available from MITSUI-DUPONT POLYCHEMICAL CO., LTD.

HIMILAN 1707: an ionomer resin of a sodium ion-neutralized ethylene-methacrylic acid copolymer, available from MITSUI-DUPONT POLYCHEMICAL CO., LTD.

TABLE 4

| Urethane cover formulation | Parts by mass |
|---|---|
| Elastollan XNY90A | 40 |
| Elastollan XNY97A | 40 |
| Pebax 5533SNOO | 20 |
| Titanium oxide | 4 |

Notes on Table 4:

ELASTOLLAN XNY90A: a thermoplastic polyurethane elastomer using 4,4'-dicyclohexylmethane diisocyanate ($H_{12}$MDI: hydrogenated MDI) available from BASF POLYURETHANE ELASTOMERS CO., LTD.

ELASTOLLAN XNY97A: a thermoplastic polyurethane elastomer using 4,4'-dicyclohexylmethane diisocyanate ($H_{12}$MDI: hydrogenated MDI) available from BASF POLYURETHANE ELASTOMERS CO., LTD.

PEBAX 5533SN00: a thermoplastic polyether-polyamide elastomer available from elf ATOCEM Japan Co., LTD.

(3-3) Preparation of the Golf Ball Body

The cover composition thus prepared was directly injection-molded onto the core to form the cover, thereby obtaining the two-piece golf ball having a diameter of 42.7 mm. The upper and lower molds for forming the cover have a spherical cavity with dimples. The part of the dimples can serve as a hold pin which is retractable. When forming the golf ball body, the hold pins were protruded to hold the core, and the resin heated at 210° C. was charged into the mold held under the pressure of 80 tons for 0.3 seconds. After the cooling for 30 seconds, the molds were opened and then the golf ball body was discharged.

(3-4) Preparation of the Mark and the Paint Film

The mark "X" having width of 8 mm, height of 8 mm, line width of 2 mm was printed on the surface of the golf ball body with the pad stamp using the ink composition for the mark shown in Table 5. Then, the paint composition prepared according to the following method was sprayed with the air-gun and dried at 40° C. to form the paint film having a thickness of 10 μm and the mark on the surface of the golf ball body. The golf ball thus obtained was each evaluated in terms of the coloring-resistance, the adhesion and the durability. The results were shown in Tables 6 to 8.

TABLE 5

| Ink composition for mark | Parts by mass |
|---|---|
| Nitrocellulose type resin | 16.8 |
| Polyester polyol | 4.2 |
| Pigment (carbon black) | 9 |
| flatting agent | 14 |
| Solvent | 49 |
| Curing agent:hexamethylene diisocyanate | 7 |

(3-5) Preparation of the Paint Composition (i) Base material: preparation of urethane polyol 116 parts by mass of PTMG650, 16 parts by mass of 1,2,6-hexane triol were dissolved into 120 parts by mass of the solvent (toluene and methylethylketone). The dibutyl-tin-dilaurylate was added in an amount of 0.1 mass % with respect to the total base material. While keeping this polyol at 80° C., 48 parts by mass of isophorone diisocyanate was slow-added into the polyol to obtain a urethane polyol having a solid content of 60 mass %, hydroxyl value of 87 mgKOH/g, and a molecular weight of 7850.

(ii) Curing agent: Isophorone diisocyanate available from Sumitomo-Bayer Urethane Co., LTD.

(iii) Mixing ratio: NCO(curing agent)/OH(base material)= 1.2 molar ratio (iv) The phosphorus stabilizer, a light-stabilizer, an UV-absorber, a fluorescent brightener described below were added into the above two-component curing type urethane paint to obtain the paint composition. The amounts of the phosphorus stabilizer, the light-stabilizer, the UV-absorber, the fluorescent brightener with respect to 100 parts by mass of the urethane resin were also shown in Table 6 to 8.

Phosphorus stabilizer: GSY-P 101 (tetrakis(2,4-di-tert-butyl-5-methylphenyl)[1,1-biphenyl]-4,4'-diylbisphsophonite) available from API corporation:

Light stabilizer: Sanol LS770 available from Sankyo Lifetech Co., LTD.

UV-absorber: Tinuvin 900 available from Ciba-Geigy Limited

Fluorescent brightener: Ubitex OB available from Ciba-Geigy

TABLE 6

| | Golf ball No. | | | | | |
|---|---|---|---|---|---|---|
| | 1 | 2 | 3 | 11 | 12 | 13 |
| Substrate of Golf ball body surface | Rubber (One-piece golf ball body) | | | | | |
| Paint film formulation (parts by mass) | — | — | — | — | — | — |
| Urethane resin | 100 | 100 | 100 | 100 | 100 | 100 |
| Phosphorus stabilizer | 0.4 | 0.06 | 4.5 | 0 | 0.03 | 7 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | — | — | — | — | — | — |
| Coloring resistance | G | G | G | P | P | G |
| Durability and Adhesion | — | — | — | — | — | — |
| Paint film (against Impact) | E | G | E | P | F | P |
| Mark (against Impact) | E | E | E | F | F | P |
| Paint film (against brush washing) | E | G | E | P | F | P |
| Mark (against brush washing) | E | G | E | F | F | P |

E: excellent,
G: good,
F: fair,
P: poor

The results of the paint film regarding the one-piece golf ball were shown in Table 6. Golf ball Nos. 1 to 3 are the cases that the paint film formed on the surface of the golf ball body contains the phosphorous stabilizer in an amount of 0.06 to 4.5 parts by mass with respect to 100 parts by mass of the urethane resin. This result indicated that the golf ball Nos. 1 to 3 were excellent in all the properties of coloring-resistance, durability and adhesion. Also, it was apparent that the adhesion and the durability of the paint film were getting improved as the amount of the phosphorus stabilizer was increased.

On the other hand, golf ball No. 11 is the case that the paint film does not contain the phosphorus stabilizer. In golf ball No. 11, none of the coloring-resistance, the durability, and the adhesion were good. Golf ball No. 12 is the case that the amount of the phosphorus stabilizer contained in the paint film is as small as 0.03 part by mass with respect to 100 parts by mass of the urethane resin. The adhesion and the durability as well as the coloring-resistance were lowered in comparison with the golf ball Nos. 1 to 3 which used the phosphorus stabilizer in an amount of 0.06 to 4.5 parts by mass. Golf ball No. 13 is the case that the amount of the phosphorus stabilizer is as too large as 7 parts by mass with respect to 100 parts by mass of the urethane resin. The adhesion and the durability of the paint film were lowered, although the change in the coloring with time was not observed. These results indicated that the appropriate amount of the phosphorus stabilizer blended in the paint film enables the paint film to show the good durability and the good adhesion even to the one-piece golf ball body obtainable by vulcanizing-molding the rubber composition. In addition, the coloring-resistance of the paint film was improved.

TABLE 7

| | Golf ball No. | | | | | |
|---|---|---|---|---|---|---|
| | 4 | 5 | 6 | 14 | 15 | 16 |
| Substrate of Golf ball body surface | Ionomer resin cover | | | | | |
| Paint film formulation (parts by mass) | | | | | | |
| Urethane resin | 100 | 100 | 100 | 100 | 100 | 100 |
| Phosphorus stabilizer | 0.4 | 0.06 | 4.5 | 0 | 0.03 | 7 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | | | | | | |
| Coloring resistance | G | G | G | P | P | G |
| Durability and Adhesion | — | — | — | — | — | — |
| Paint film (against Impact) | E | G | E | P | F | P |
| Mark (against Impact) | E | G | E | F | F | P |
| Paint film (against brush washing) | E | G | E | P | P | P |
| Mark (against brush washing) | E | G | E | F | F | P |

E: excellent,
G: good,
F: fair,
P: poor

The results of the paint film regarding the golf ball having the ionomer cover as the cover material were shown in Table 7. Golf ball Nos. 4 to 6 are the cases that the paint film formed on the surf ace of the golf ball body contains the phosphorus stabilizer in an amount of 0.06 to 4.5 parts by mass with respect to 100 parts by mass of the urethane resin. This result indicated that the golf ball Nos. 4 to 6 were excellent in all the properties of coloring-resistance, durability and adhesion. Also, it was apparent that the adhesion and the durability of the paint film were getting improved as the amount of the phosphorus stabilizer was increased.

On the other hand, golf ball No. 14 is the case that the paint film does not contain the phosphorus stabilizer. In golf ball No. 14, none of the coloring-resistance, the durability, and the adhesion were good. Golf ball No. 15 is the case that the amount of the phosphorus stabilizer contained in the paint film was as small as 0.03 part by mass with respect to 100 parts by mass of the urethane resin. The adhesion and the durability as well as the coloring-resistance were lowered. Golf ball No. 16 is the case that the amount of the phosphorus stabilizer was as too large as 7 parts by mass with respect to 100 parts by mass of the urethane resin. The adhesion and the durability of the paint film were extremely lowered, although the change in the coloring with time was not observed. These results indicated that the appropriate amount of the phosphorus stabilizer blended in the paint film enables the paint film to show the good durability and the good adhesion even to the cover using the ionomer resin as a cover material. In addition, the coloring-resistance of the paint film was improved.

TABLE 8

| | Golf ball No. | | | | | |
|---|---|---|---|---|---|---|
| | 7 | 8 | 9 | 17 | 18 | 19 |
| Substrate of Golf ball body surface | Urethane resin cover | | | | | |
| Paint film formulation (parts by mass) | | | | | | |
| Urethane resin | 100 | 100 | 100 | 100 | 100 | 100 |
| Phosphorus stabilizer | 0.4 | 0.06 | 4.5 | 0 | 0.03 | 7 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | | | | | | |
| Coloring resistance | G | G | G | P | P | G |
| Durability and Adhesion | — | — | — | — | — | — |
| Paint film (against Impact) | E | G | E | P | F | P |
| Mark (against Impact) | E | G | E | F | F | P |
| Paint film (against brush washing) | E | G | E | P | P | P |
| Mark (against brush washing) | E | G | E | F | F | P |

E: excellent,
G: good,
F: fair,
P: poor

The paint films of the golf ball using the urethane resin as the cover material were evaluated. The results were shown in Table 8. Golf ball Nos. 7 to 9 are the cases that the paint film formed on the surface of the golf ball body contains the phosphorus stabilizer in an amount of 0.06 to 4.5 parts by mass with respect to 100 parts by mass of the urethane resin. On the other hand, golf ball No. 14 is the case that the phosphorus stabilizer was not contained, golf ball No. 18 is the case that the stabilizer was contained in an excessively small amount, and golf ball No. 19 is the case that the stabilizer was contained in an excessively large amount. As shown in the case of the cover using the ionomer resin, it was apparent that the golf ball Nos. 7 to 9 were excellent in all the properties of coloring-resistance, durability and adhesion.

The present invention provides a golf ball having a paint film which does not change in color with time. Further, the paint film in the present invention exhibits the excellent adhesion and the durability. Especially, the present invention provides a golf ball having a paint film which exhibit the adhesion and the durability to the golf ball surface which is composed of the rubber, the ionomer resin, and the urethane resin.

This application is based on Japanese Patent application No. 2003-061942 filed on Mar. 7, 2003, the contents of which are hereby incorporated by reference.

What is claimed is:

1. A golf ball comprising:

a paint film formed on a surface of a golf ball body, wherein the paint film contains 0.05 to 5 parts by mass of a phosphorous stabilizer with respect to 100 parts by mass of a resin component, said resin component contains a two-component curing urethane resin obtainable by curing a urethane polyol with a polyisocynate, and said phosphorous stabilizer is tetrakis (2,4-di-tert-butyl-5-methylphenyl)[1,1'-biphenyl]-4,4'-diylbisphosphonite, or a derivative thereof.

2. The golf ball according to claim 1, wherein the golf ball has a cover which contains an ionomer resin or a urethane resin as a cover material.

3. The golf ball according to claim 1, wherein the paint film has a single-layered structure.

4. The golf ball according to claim 1, wherein the golf ball is a one-piece golf ball.

5. The golf ball according to claim 1, wherein the golf ball is a two-piece golf ball.

6. The golf ball according to claim 1, wherein the golf ball is a multi-piece golf ball.

7. The golf ball according to claim 1, wherein the golf ball is a wound-core golf ball.

8. The golf ball according to claim 1, wherein said paint film has a thickness of 5 to 20 μm.

* * * * *